United States Patent [19]

Schlack

[11] Patent Number: 4,554,995

[45] Date of Patent: Nov. 26, 1985

[54] ARRANGEMENT FOR PROVIDING HEAT TO A PERSONNEL BUCKET OF AN AERIAL LIFT VEHICLE

[76] Inventor: Ronald A. Schlack, R.D. #2, Box 2266, Orwigsburg, Pa. 17961

[21] Appl. No.: 706,845

[22] Filed: Feb. 28, 1985

[51] Int. Cl.[4] ..... B66F 11/04

[52] U.S. Cl. ..... 182/129; 182/2

[58] Field of Search ..... 182/2, 129, 46, 47, 182/51, 52, 222

[56] References Cited

U.S. PATENT DOCUMENTS

| | | | |
|---|---|---|---|
| 3,451,505 | 6/1969 | Hulin | 182/129 |
| 3,605,941 | 9/1971 | Edwards | 182/2 |
| 3,670,849 | 6/1972 | Milner | 182/2 |
| 3,695,390 | 10/1972 | Leigh | 182/2 |
| 3,817,007 | 6/1974 | Hall | 52/118 |
| 4,252,215 | 2/1981 | Bell | 182/2 |

*Primary Examiner*—Reinaldo P. Machado

[57] ABSTRACT

An arrangement for providing heat to the working environment of a bucket attached to an aerial lift vehicle is disclosed. A tubing arrangement is located at the bottom of the bucket and is receptive to heated hydraulic fluid. The hydraulic fluid is commonly available at the bucket of aerial lift vehicles for operation of the bucket and boom structures. Since the hydraulic fluid may reach temperatures of 120° F., the circulation of the hydraulic fluid through the tubing structure in the bucket will radiate heat throughout the bucket. In a preferred embodiment of the present invention, the tubing is encased in a mat which can be placed in the bottom of the bucket. Input and output couplers are used to attach the hydraulic hoses to the mat. The control of hydraulic fluid flow through such an arrangement may be provided either at the bucket itself or in the vehicle.

7 Claims, 5 Drawing Figures

ARRANGEMENT FOR PROVIDING HEAT TO A PERSONNEL BUCKET OF AN AERIAL LIFT VEHICLE

BACKGROUND OF THE INVENTION

1. Field of the Invention

The present invention relates to means for providing heat to persons working in the elevated bucket of an aerial lift vehicle and, more particularly, to a heating means which allows for heated hydraulic fluid, available at the bucket, to be passed through a piping, or tubing, arrangement located on the floor of the bucket, where the heat from the hydraulic fluid will radiate through the bucket.

2. Description of the Prior Art

For people who work in elevated buckets (variously referred to in the art as buckets, baskets, or platforms), severe cold weather often limits the length of time they can remain in the bucket without suffering undue hardship. It has been proposed in the past that specially designed articles of clothing, for example, various types of diving suits, space suits, asbestos suits, or the like, be worn to protect the individual from the cold. Although these suits do provide a degree of warmth, their bulkiness greatly lessens the mobility of the wearer, often to the point where assinged tasks cannot be performed.

One specific arrangement for providing heat to a workman in a elevated bucket is described in U.S. Pat. No. 3,451,505 issued to B. R. Hulin on June 24, 1969. The Hulin arrangement, in general, provides a source of controlled temperature air which is mounted on either the truck or the boom, and is interconnected via a conduit with the bucket. In order to confine the heated air to the bucket area, a sealing means, or lid, is connected to the top of the bucket. The lid includes a hole large enough to allow a worker to gain entry to the bucket. The worker then wears a torso garment which is attached to the sealing lid to further prevent the escape of the heated air. Although this arrangement does provide a source of heat to the worker, his mobility is again severely limited do to the connection of the torso garment to the sealing lid.

An alternative arrangement, which does not hamper mobility, is disclosed in U.S. Pat. No. 3,605,941 issued to C. P. Edwards on Sept. 20, 1971. In this arrangement, an electrical outlet box is mounted on a side wall of the bucket. An electrically operated, heater, therefore, may be directly plugged into the outlet box to provide heat. Such an arrangement, however, is not practical for use with aerial lift vehicles working with or near high voltage electric power lines.

Thus, a need remains for an arrangement capable of providing heat to elevated buckets which does not impede the mobility of the worker and is sufficiently safe for use in association with, for example, electric utility aerial lift vehicles.

SUMMARY OF THE INVENTION

The problem remaining in the prior art has been solved in accordance with the present invention which relates to means for providing heat to persons working in the elevated bucket of an aerial lift vehicle and, more particularly, to a heating means which allows for heated hydraulic fluid, available at the bucket, to be passed through a piping arrangement located on the floor of the bucket, where the heat from the hydraulic fluid will radiate through the bucket.

It is an aspect of the present invention to provide a simple means of heating the floor area of an elevated bucket by using as a source of heat the hydraulic fluid which is already available at the bucket.

A further aspect of the present invention is to provide a floor mat which contains internal tubing to be placed in the bottom of the bucket and attached to the source of hydraulic fluid so as to provide the heat to the elevated bucket.

Yet a further aspect of the present invention is to include a series of relatively small holes in the top cover of the floor mat in order to provide greater heat transfer between the hydraulic fluid passing through the internal piping and the bucket.

An additional aspect of the present invention is to provide a means of heating the bucket which can be completely disconnected from the bucket, for example, to ease repair or merely to remove during warmer weather.

An alternative aspect of the present invention is to include the internal piping directly in the molded material used to form the bucket so as to eliminate the need for additional components to be used to provide heat.

Yet another aspect of the present invention is to provide a means of heating the floor of an elevated bucket which can be controlled either by the worker in the bucket or personnel in the associated aerial vehicle.

Other and further aspects of the present invention will become apparent during the course of the following discussion and by reference to the accompanying drawings.

BRIEF DESCRIPTION OF THE DRAWINGS

Referring now to the drawings, where like numerals representing like parts in several views.

DETAILED DESCRIPTION

Figure 1:
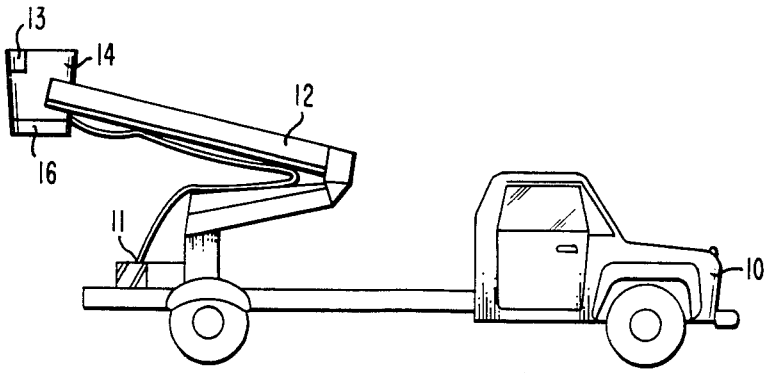
FIG. 1 illustrates an exemplary aerial lift vehicle, including a boom structure and bucket, which utilizes the bucket floor heating arrangement of the present invention.

A typical work vehicle 10 which includes an hydraulically operated boom 11 and bucket 14 is shown in FIG. 1. Vehicle 10 may be a truck for use in any of a number of activities, including, but not limited to, electric utility, cable television, telephone, gas, tree-trimming etc. Boom 12 is operated in a conventional hydraulic fashion, where the hydraulic fluid is contained in a reservoir 11 within truck 10, so as to raise and lower boom 12 as desired. A complete description of the operation of such a boom may be found in U.S. Pat. No. 3,817,007 issued to T. R. Hall on June 18, 1974.

In accordance with one embodiment of the present invention, a heated mat 16 is located on the floor of bucket 14 to provide radiant heat to persons working in bucket 14. As will be described in detail hereinafter, mat 16 includes an internal tubing structure 18 which is receptive to the hydraulic fluid used to raise and lower boom 12. Since the hydraulic fluid may be heated, and often reaches a temperature of approximately 120° F., the motion of the heated hydraulic fluid through internal tubing structure 18 will act as a source of radiant heat to persons working in bucket 14.

Figure 2:
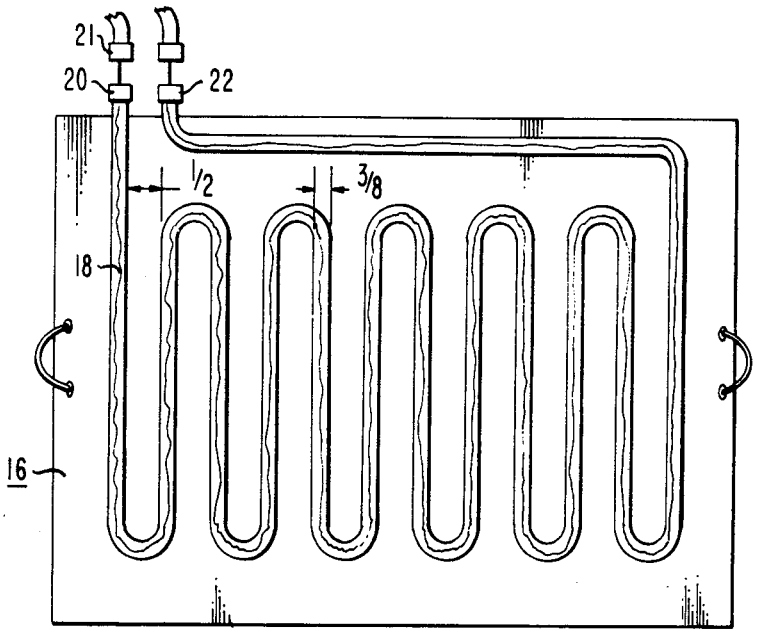
FIG. 2 illustrates in detail a cut-away top view in perspective of an exemplary floor mat for providing heated hydraulic fluid to an elevated bucket in accordance with the present invention.

FIG. 2 illustrates in detail a cut-away top view in perspective of an exemplary mat 16 of the present invention. Although mat 16 is illustrated as having a rectangular shape, it is to be understood that a heated mat formed in accordance with the present invention may comprise any shape desired as to conform with the floor of the bucket in use. Other common shapes include, but are not limited to, circular, square, oval, or U-shaped. Referring to FIG. 2, internal tubing 18 is seen to follow a path which provides for the dissemination of heat over a major portion of the surface area of the floor of the bucket. Although shown as following a serpentine pattern around mat 16, internal tubing 18 may be arranged in any suitable pattern. The heated hydraulic fluid enters tubing 18 via a coupler 20, referred to as an input coupler, flows through tubing 18, and exits mat 16 via a second coupler 22, referred to as an output coupler. In the preferred embodiment of the invention, internal tubing 18 may comprise plastic tubing of approximately 3/8" in diameter, where continuous sections of piping 18 are spaced approximately ½" apart. However, it is to be understood that other dimensions for both pipe diameter and spacing between adjacent sections of pipe, as well as other materials to form the piping itself, for example, high pressure hose, may be used in accordance with the present invention.

By passing the heated hydraulic fluid, which may reach temperatures of approximately 120° F., through tubing 18, heat will be radiated through mat 16 to warm persons working in bucket 14. The heated fluid may be kept in a reservoir 11 included in vehicle 10, where the temperature of the fluid may be monitored by any method well known in the art, including but not limited to, electrical monitoring dipsticks. Additional activating means 13 may be included in bucket 14 to allow the person working therein to initiate the flow of heated hydraulic fluid through mat 16. Alternatively, activations means 13 may be directly included in vehicle 10.

Figure 3:
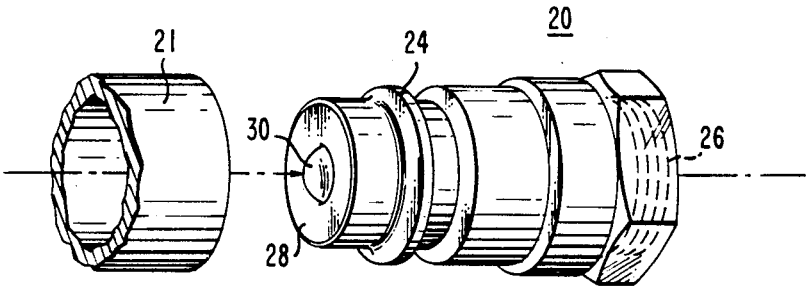
FIG. 3 illustrates in detail an exemplary coupler which may be used as either an input or output coupler between the source of hydraulic fluid and the piping used to provide heat to the floor of the elevated bucket.

Couplers 20 and 22 for connecting the heated hydraulic fluid to tubing 18 may comprise standard hydraulic coupling arrangements, one exemplary arrangement comprising a detachable locking pin and ball, used to couple hydraulically operated hand tools to a source of hydraulic fluid. FIG. 3 illustrates such an exemplary coupler 20, as well as the mating hose coupler 21 which is connected to a source of heated hydraulic fluid (not shown). As illustrated in FIG. 3, coupler 20 comprises a metal housing 24 which is threaded at a first end 26 for mating with internal tubing 18. The second, opposite end 28 of coupler 20 contains a ball bearing 30 of a diameter greater than the inner diameter of coupler 20. Thus, when a sufficient pressure of hydraulic fluid (as represented by the arrow in FIG. 3) is exerted against ball bearing 30, ball bearing 30 will move into coupler 20, allowing the hydraulic fluid to flow through coupler 20 and enter internal tubing 18. It is to be understood that the output coupler 22 will be attached between internal tubing 18 and the source of hydraulic fluid in a reverse manner so as to allow the fluid to exit tubing 18 and be returned to the fluid reservoir.

The coupling arrangement illustrated in FIG. 3, as well as many other conventional coupling arrangements, are designed to allow the hydraulically operated instrument to be quickly detached from the source of hydraulic fluid. Therefore, heated mat 16 formed in accordance with the present invention may be detached from the hydraulic reservoir and completely removed from bucket 14, if desired. To simplify removal, loops, or other hooking means, may be added to mat 16, as illustrated in FIG. 2.

Figure 4:
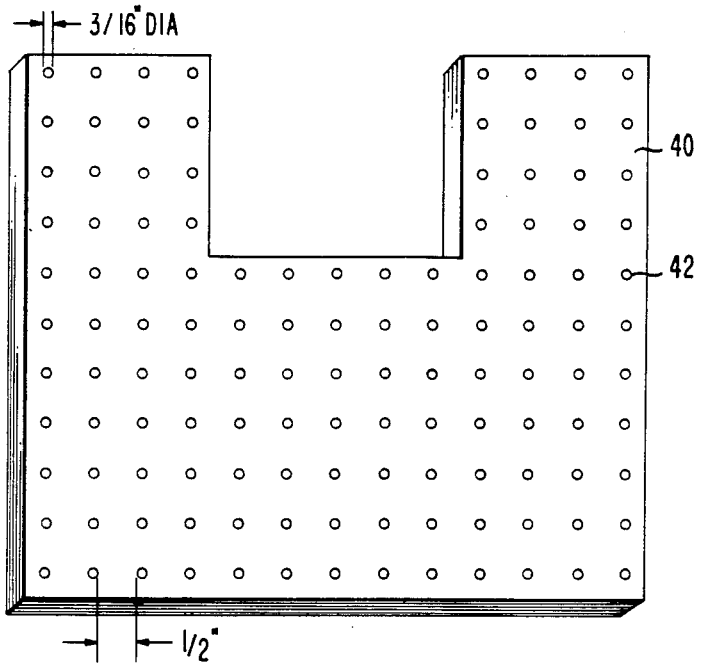
FIG. 4 illustrates a top view of an exemplary floor mat used for providing heat in accordance with the present invention which includes a plurality of relatively small holes in the cover the floor mat to expedite the transfer of heat from the hydraulic fluid to the bucket.

In order to provide an even greater heat exchange between internal tubing 18 and persons working in bucket 14, holes of relatively small diameter may be formed in cover layer 40 of mat 16. FIG. 4 illustrates a top view of such an arrangement, where mat 16 is here illustrated as having a U-shaped profile. As shown, top layer 40 includes a plurality of relatively small holes 42. The number and location of holes 42 is considered to be arbitrary. In the particular embodiment illustrated in FIG. 4, holes 42 are shown as being 3/16" in diameter and spaced ½" apart.

Figure 5:
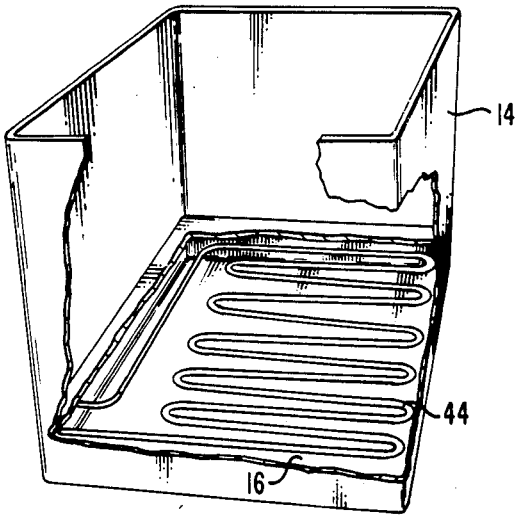
FIG. 5 illustrates a cut-away view in perspective of an alternative arrangement of the present invention wherein the internal piping for providing the heat is directly formed in the floor of the bucket.

In an alternative embodiment of the present invention, as mentioned above, internal tubing 18 may be directly included in the floor area of bucket 14 so as to be considered an integral part of bucket 14. An illustration of this arrangement is shown in FIG. 5. Here, tubing 18 is formed directly in floor area 44 and couplers 20 and 22 are attached directly to a sidewall of bucket 14, similar to the arrangement previously discussed. Additionally, tubing 18 may be incorporated into a liner, used in common practice, which is fitted into the bucket. A disadvantage of these direct incorporation arrangements is that the heating means may not be removed. However, some situations may arise where it is disadvantageous to utilize a separate mat and the arrangement shown in FIG. 5 provides a viable alternative.

It is to be understood that the above-described embodiments are simply illustrative of the principles of the invention. Other and further means of providing heated hydraulic fluid to an internal piping structure included in an aerial lift bucket to provide a source of heat to persons working in the bucket are considered to be obvious and within the spirit and scope of the present invention.

What is claimed is:

1. An arrangement for providing heat to a bucket associated with an aerial lift vehicle, the arrangement comprising a tubing arrangement located at the bottom of said bucket, said tubing arrangement including an input coupler and an output coupler, said input coupler for receiving heated hydraulic fluid from an external source for circulation through said tubing arrangement, said heated hydraulic fluid circulating through said tubing arrangement thus providing a source of radiated heat to said bucket and subsequently exits said tubing arrangement though said output coupler.

2. The arrangement as defined in claim 1 wherein the tubing arrangement is directly formed in the bottom of the bucket so as to form an integral part of said bucket.

3. The arrangement as defined in claim 1 wherein the tubing arrangement is formed in a separate mat structure, the separate mat structure capable of being placed on the bottom of the bucket.

4. The arrangement as defined in claim 3 wherein the mat structure includes a top cover portion which contains a plurality of relatively small diameter holes disposed over the surface thereof, said plurality of holes providing an increase in heat exchange between the tubing arrangement and the bucket.

5. The arrangement as defined in claim 4 wherein each hole of the plurality of holes comprises a diameter of approximately 3/16" and individual holes are spaced approximately ½" apart.

6. The arrangement as defined in claim 1 wherein the tubing arrangement comprises plastic tubing.

7. The arrangement as defined in claim 6 wherein the plastic tubing comprises a diameter of 3/8".

* * * * *